United States Patent [19]

Parker et al.

[11] 4,140,557

[45] Feb. 20, 1979

[54] HIGH STRENGTH AND HIGH TOUGHNESS STEEL

[75] Inventors: Earl R. Parker, El Cerrito; Victor F. Zackay, Berkeley, both of Calif.

[73] Assignee: The United States of America as represented by the United States Department of Energy, Washington, D.C.

[21] Appl. No.: 871,713

[22] Filed: Jan. 23, 1978

Related U.S. Application Data

[60] Continuation of Ser. No. 466,346, May 2, 1974, abandoned, which is a division of Ser. No. 249,585, May 2, 1972, Pat. No. 3,836,407.

[51] Int. Cl.[2] ..... C22C 38/06; C22C 38/14

[52] U.S. Cl. ..... 148/36; 75/123 K; 75/123 M; 148/31

[58] Field of Search ..... 75/123 K, 123 M; 148/36, 134, 143

[56] References Cited

U.S. PATENT DOCUMENTS

| | | | |
|---|---|---|---|
| 846,979 | 3/1907 | Churchward | 75/123 M |
| 2,048,163 | 7/1936 | Pilling et al. | 75/123 M |
| 2,105,652 | 1/1938 | Honda | 75/123 M |
| 2,266,481 | 12/1941 | Talbot | 75/123 K |
| 2,532,117 | 11/1950 | Newell | 148/134 X |

FOREIGN PATENT DOCUMENTS

| | | | |
|---|---|---|---|
| 194508 | 2/1938 | Switzerland | 75/123 M |
| 352964 | 7/1931 | United Kingdom | 75/123 M |

OTHER PUBLICATIONS

Fiz., Metal Metalloved, 24, No. 6, pp. 126–128.

Metall Wirtschoft, Dec. 19, 1930, pp. 1043–1045, Kroll.

*Primary Examiner*—Arthur J. Steiner

*Attorney, Agent, or Firm*—Dean E. Carlson; R. S. Gaither; L. E. Carnahan

[57] ABSTRACT

A structural steel which possess both high strength and high toughness and has particular application of cryogenic uses. The steel is produced by the utilization of thermally induced phase transformation following heating in a three-phase field in iron-rich alloys of the Fe-Ni-Ti system, with a preferred composition of 12% nickel, 0.5% titanium, the remainder being iron.

2 Claims, 4 Drawing Figures

HIGH STRENGTH AND HIGH TOUGHNESS STEEL

BACKGROUND OF THE INVENTION

The invention described herein was made in the course of, or under, Contract No. W-7405-Eng-48, with the United States Atomic Energy Commission.

This is a continuation of application Ser. No. 466,346, filed May 2, 1974, now abandoned, which constituted a division of application Ser. No. 249,585, filed May 2, 1972, now U.S. Pat. No. 3,836,407 issued Sept. 17, 1974.

This invention relates to structural steels, and more particularly to a structural steel and method for producing a steel possessing both high strength and high toughness suitable for use in cryogenic service.

The design requirements of structures intended for cryogenic service are demanding and complex. Among the most important of these is safety. Consequently, high fracture toughness is mandatory. Another requirement is that the yield strength should be as high as possible to minimize section thickness. The use of thinner material enhances fracture toughness and minimize cost.

Steel generally used for cryogenic service are limited in number. A commonly used austentic steel has a high toughness, but a low strength (about 40,000 psi yield strength). Another common steel contains low carbon and 9 percent nickel has about 120,000 psi yield strength; this steel has a relatively low toughness. Efforts, particularly by the Japanese, have been directed to developing a steel similar to the present invention, but these efforts have resulted in alloys containing carbon in the composition. It is known that even some quantities of carbon and nitrogen in steels cause embrittlement at low temperatures and thus reduces the toughness. Accordingly, carbon containing steels are not entirely satisfactory for cryogenic application. Thus, there is a need for a structural steel which eliminates carbon and possess both high strength and high toughness, such a steel having particular applicability for cryogenic service.

SUMMARY OF THE INVENTION

The present invention fills the above-mentioned need in the art for structural steels which possess both high strength and high toughness at low temperatures, this being accomplished by a thermally induced phase transformation in iron-rich alloys of the Fe-Ni-Ti system.

Therefore, it is an object of the invention to provide a high strength, high toughness steel.

A further object of the invention is to provide a cryogenic steel which includes no carbon in the composition thereof.

Another object of the invention is to provide a high toughness cryogenic steel which utilizes a thermally induced phase transformation in the processing thereof.

Another object of the invention is to provide a method for producing a high strength, high toughness steel.

Another object of the invention is to provide a method for producing an Fe-Ni-Ti steel.

Other objects of the invention will become readily apparent from the following description and accompanying drawings.

DESCRIPTION OF THE INVENTION

As pointed out above, the design requirements of structures intended for cryogenic service are demanding and complex, safety being the most important of these requirements, thus high fracture toughness is mandatory. Also, the yield strength should be as high as possible to minimize section thickness.

Steels generally used in cyrogenic service are limited in number. One commonly used austenitic steel (AISE TYPE 304) has a high toughness, but a low strength (about 40,000 psi yield strength). Another common steel which is utilized contains low carbon and 9 percent nickel has high strength (about 120,000 psi yield strength), but has a relatively low toughness. Thus neither of these conventionally used cryogenic structural steels possess both high strength and high toughness. Again, it is pointed out that carbon and nitrogen cause embrittlement of the steel at low temperatures.

The present invention provides a superior cryogenic alloy which utilizes an intermetallic compound believed to be $Ni_3$-Ti, to provide high strength, with no carbon or nitrogen content, and thus does not embrittle at low temperatures, thereby producing a steel which possess both high strength and high toughness.

The inventive cryogenic alloy was discovered by using the basic principles of materials science. In terms of defect theory, strength is enhanced by immobilizing dislocations. Toughness is increased, at a given strength level, by providing a high density of mobile dislocations. The latter are necessary for the degree of plasticity that is required for high fracture toughness. This desirable combination is generally absent in the prior art cryogenic alloys, but is found in the present inventive structural steel, whereby high strength and high toughness are obtained.

In view of the need in the cryogenic field for a structural steel having both high strength and high toughness, this problem was resolved by the present invention by utilizing a thermally induced phase transformation which would allow selective decoration of some, but not all, dislocations. An example of such a transformation is found in the iron-rich alloys of the Fe-Ni-Ti system. (These alloys are not steels in the conventional sense, but are often classed as such).

Figure 1:
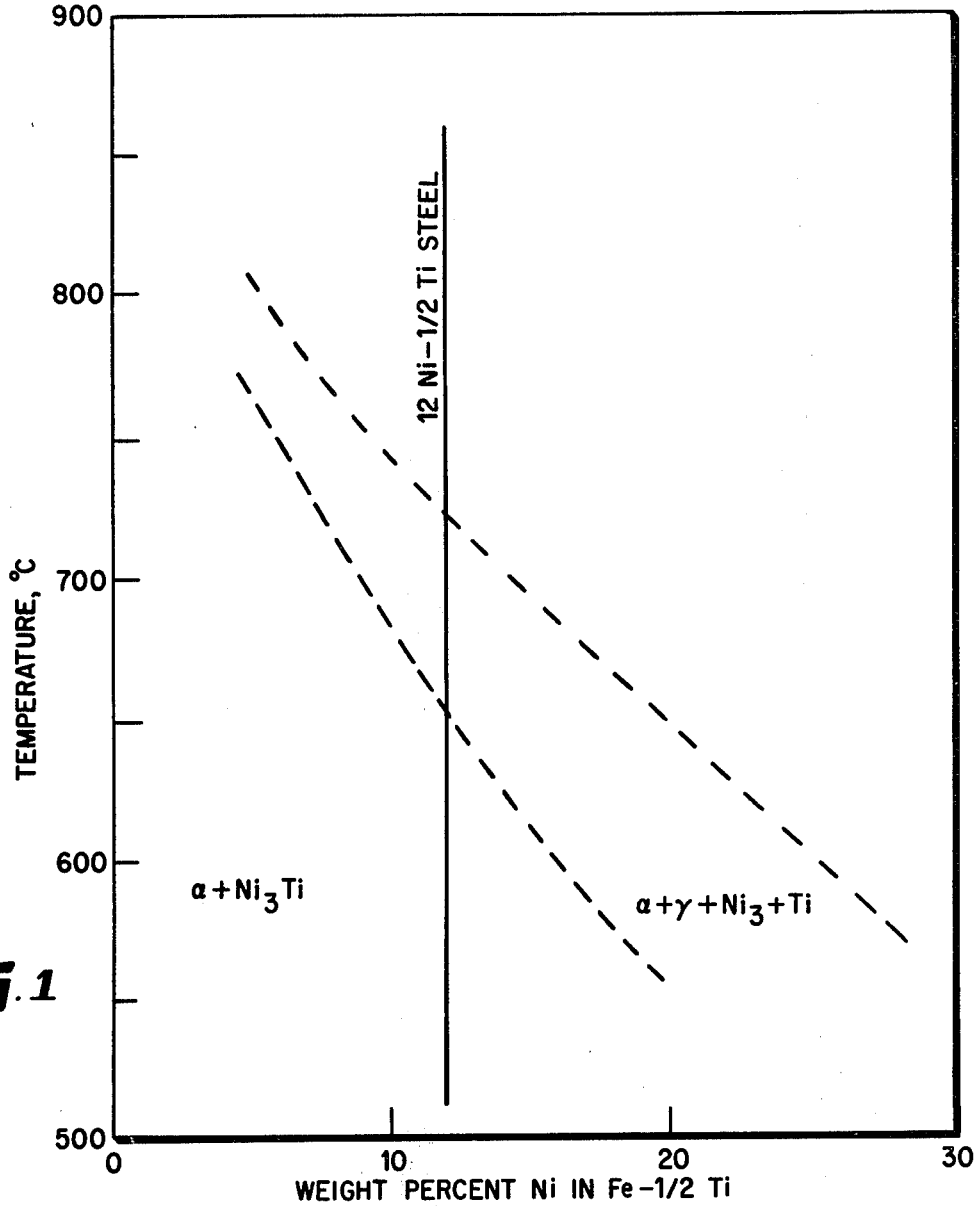
FIG. 1 is a phase diagram of the inventive Fe-Ni-Ti system showing the transformation temperatures for the 12Ni-0.5Ti steel.

Although the temperature vs. composition of the alpha ($\alpha$) or body-centered-cubic (BCC) and the gamma ($\gamma$) or face-centered-cubic (FCC) phase boundaries in the Fe-Ni-Ti system are not precisely known, for small concentrations of titanium (Ti) it was found by dilatometric tests that they were similar to, but slightly higher than, those of the Fe-Ni system. The phase diagram shown in FIG. 1 is based on dilatometric and metallographic tests of the steel or alloy composition chosen (12 percent Ni, 0.5 percent Ti) to conduct the tests, and it is clear that iron-rich Fe-Ni-Ti system consists of a two phase (BCC) region (i.e. $\alpha+Ni_{\alpha}Ti_{\gamma}$) at low temperatures (up to about 650° C.); three phases (i.e., $\alpha+\gamma\lambda+Ni_3Ti$) at an intermediate temperature (about 650° C. to about 720° C.); and a single phase ($\gamma$) in the FCC region at the highest temperature (above about 720° C.). The nickel-titanium phase is believed to be hexagonal $Ni_3Ti$.

The existence of the three phase region at intermediate temperature, as illustrated in FIG. 1 between the dash lines, provides for selectively decorating some dislocations, with the opportunity to allow others to be free to move when a stress exceeding the yield strength is applied. The $\gamma\rightarrow\alpha$ transformation during fast cooling presumably produces dislocations that are free to move. The upper (right) dash line in FIG. 1 represents the start of the $\gamma\rightarrow\alpha$ transformation, while the lower (left) dash line represents the end of the $\gamma\rightarrow\alpha$ transformation on cooling. The precipitation of $Ni_3Ti$ occurs only on dislocations in the BCC phase, and only at elevated temperatures. Hence, the ratio of the densities of immobilized and mobile dislocations can be controlled by regulating the ratio of the volume fractions of BCC ($\alpha$) and FCC ($\gamma$) phases during heat treatment in the three phase field. The latter ratio is uniquely determined by the heat treating temperature. Upon quenching to room temperature, the FCC phase transforms to BCC by a martensitic reaction, producing a large number of mobile dislocations. Thus, based on the experiments conducted on the inventive alloy, in principle, it should be possible to produce alloys with different combinations of strength and toughness.

Figure 2:
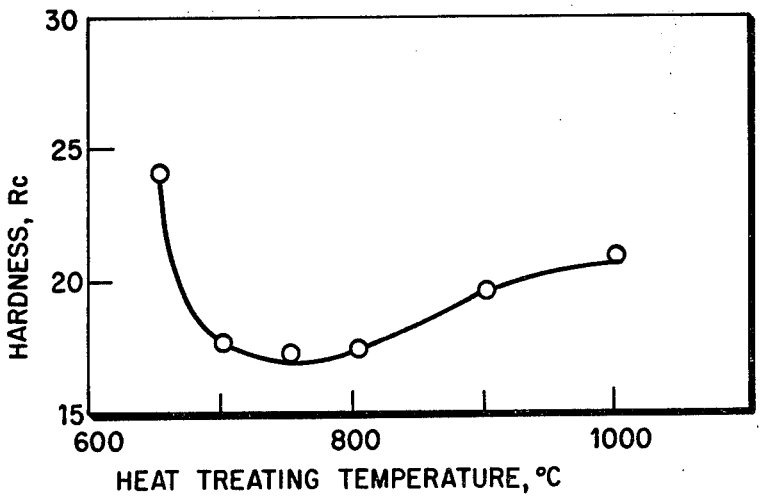
FIG. 2 graphically illustrates the heat treating temperature vs. the room temperature hardness for the 12Ni-0.5Ti steel.
Figure 3:
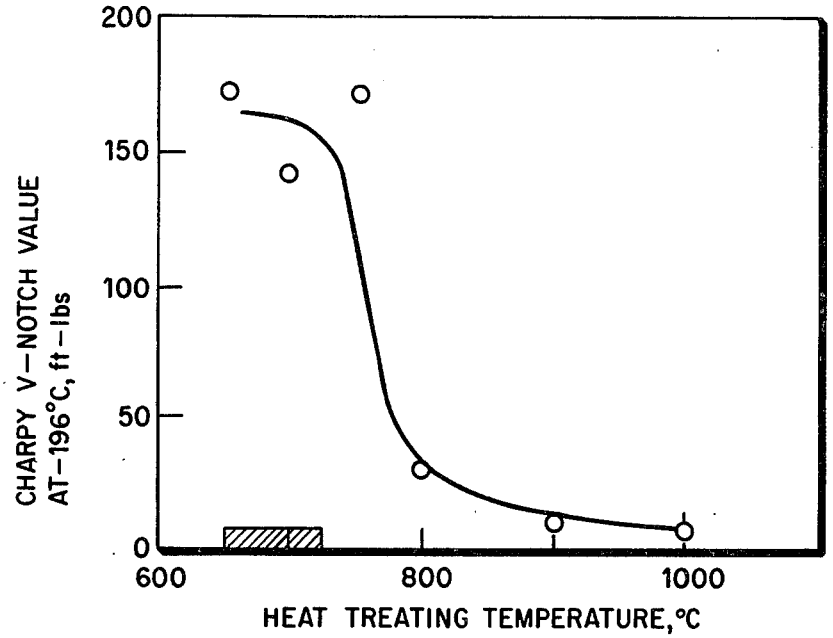
FIG. 3 graphically illustrates the heat treating temperature vs. the Charpy-V notch value at −196° C. for the 12Ni-0.5Ti steel, with the heavy bar on the abscissa indicating the three phase region ($\alpha+\gamma+Ni_3Ti$)

The influence of the heat treating temperature on the hardness at room temperature is shown in FIG. 2, while the influence of the heat treating temperature on the toughness (as measured by the Charpy-V-notch value at −196° C.), is shown in FIG. 3. The heavy bar shown on the abscissa of FIG. 3 indicates the approximate temperature range (about 650° C. to 720° C.) of the three phase region described above with respect to FIG. 1. For heat resting temperatures associated with the single phase ($\gamma$) region (see FIG. 1), both the hardness and the toughness were low, as indicated in FIGS. 2 and 3. For temperatures corresponding roughly to equal proportions of gamma and alpha (between the dash lines in FIG. 1), with a small volume fraction of $Ni_3Ti$, the toughness was approximately eight times greater than that resulting from quenching from the single phase ($\gamma$) region (see FIG. 3). For decreasing temperatures between about 720° C. and 650° C., corresponding to increasing volume fractions of $\alpha$ relative to $\gamma$, the expected increase in hardness was observed (see FIG. 2).

Two Chargy bars of the 12Ni-0.5Ti alloy, given solution heat treatments of 800° and 700° C., respectively, were broken at −196° C. and the high degree of plasticity associated with the fracture of the bar treated at 700° C. was evident. The specimen heat treated in the 700° C. three phase region ($\alpha+\gamma+Ni_3Ti$) exhibited a higher degree of plastic deformation and a much greater toughness (140 ft. lbs.) as opposed to the one heat treated in the 800° C. single phase ($\gamma$) region (30 ft. lbs.).

Figure 4:
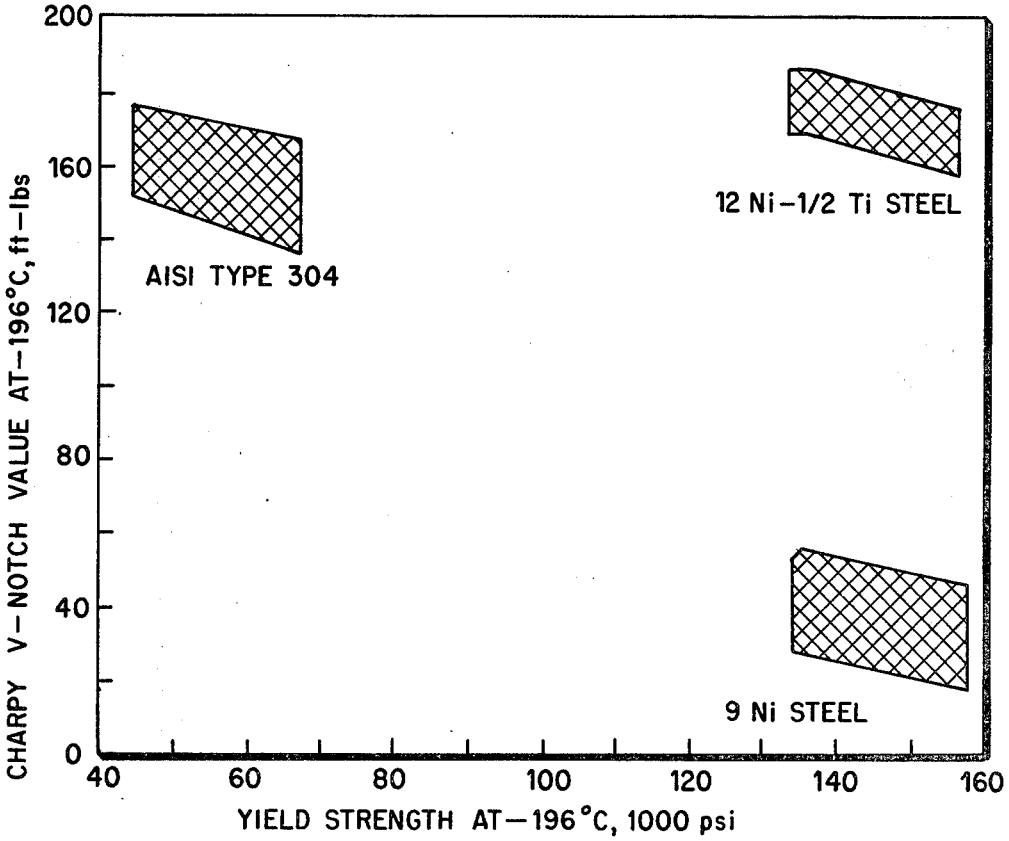
FIG. 4 is a comparative plot of the yield strength and the toughness, both measured at −196° C., for two prior art commercial cryogenic steels and the inventive Fe-Ni-Ti system for the 12Ni-0.5Ti steel.

The toughness and yield strength at −196° C. for the two above-mentioned commercial steels, namely; AISI Type 304 and 9Ni, are contrasted with those of the inventive 12Ni-0.5Ti steel in FIG. 4. As pointed out above, but clearly illustrated in FIG. 4, the AISI Type 304 steel (An FCC steel) has high toughness but low yield strength, while the 9Ni steel (a BCC steel) has high yield strength but low toughness. As clearly seen by comparison of FIG. 4 the inventive Fe-Ni-Ti steel (a BCC steel) has the high toughness of the type 304 steel and the high yield strength of the 9Ni, thereby filling a need for a structural steel which possess both desired characteristics.

While the above description and the following processing description is directed to an Fe-Ni-Ti system wherein the Ni is 12 percent by weight and the Ti is 0.5 percent by weight, it is not intented to limit the inventive steel to these percentages, since nickel in the range of 8–16 percent and titanium in the range of 0.25 to 1 percent, with the remainder iron, produces a satisfactory steel in both high toughness and yield strength. Also, it is not intended to restrict the use of the inventive structural steel to cryogenic applications (−196° C.) but the steel or alloy can be effectively utilized wherever a need for similar requirements as to toughness and yield strength are found.

To illustrate the process for producing the inventive steel, the following is directed to the operational sequence for producing the 12Ni-0.5Ti alloy:

1. Heat to 800°–1,000° C. for a time period long enough to desolve the Ni-Ti compound. This time will vary from 15 minutes to several hours, depending on the thickness of the material.

2. Cool rapidly to room temperature. Thin pieces may be air cooled, with thicker pieces being water or oil quenched.

3. Reheat to 650°–720° C. The furnace utilized may be a commercial furnace utilized for heat treating stainless steels. This step desolves the fraction of the volume of the compound that is in the high temperature phase (FCC). The part of the volume that remains in the low temperature phase (BCC) does not desolve. This temperature is maintained from 15 minutes to 8–10 hours, depending on the material thickness.

4. Cool to room temperature. If thick, over ¼ inch for example, it may be desireable to oil or water cool, otherwise air cooling is sufficient.

It has thus been shown that the invention has provided a structural steel which contains no carbon and possess both high strength and high toughness, thus having particular application for cryogenic service.

While a particular embodiment of the invention has been described, it is not intended to limit the invention to the particular composition, and it is intended to cover in the appended claims all embodiments which come within the spirit and scope of the invention.

What we claim is:

1. A carbon-free, two phase alloy having both high strength and high toughness consisting essentially of iron, nickel in the concentration range from 8 to 16 weight percent, and titanium in the concentration range from 0.25 to 1 weight percent, one of said phases having a body-centered-cubic (BCC) lattice, and the other of said phases being hexagonal $Ni_3Ti$, said alloy having at least 120,000 psi strength at −196° C. and 120 charpy v-notch toughness at −196° C.

2. The alloy of claim 1 containing nickel in a concentration of about 12 percent and titanium in a concentration of about 0.5 percent.

* * * * *